US005121582A

United States Patent [19]

Volgamore et al.

[11] Patent Number: 5,121,582

[45] Date of Patent: Jun. 16, 1992

[54] SOAP DISH ANCHORING SYSTEM

[76] Inventors: Michael D. Volgamore, 259 Pajaro Ave., Ventura, Calif. 93004; Jack E. Gannon, 6450 Webster St. Apt. 349, Ventura, Calif. 93003

[21] Appl. No.: 731,986

[22] Filed: Jul. 18, 1991

[51] Int. Cl.[5] ..... E04F 19/00

[52] U.S. Cl. ..... 52/27; 248/205.3; 52/35

[58] Field of Search ..... 248/205.3, 300; 52/34, 52/35, 36, 27, 37, 743, 741, 746

[56] References Cited

U.S. PATENT DOCUMENTS

| | | | |
|---|---|---|---|
| 1,704,105 | 3/1929 | Saver | 52/35 |
| 1,712,202 | 5/1929 | Eggers | 52/35 |
| 1,919,354 | 7/1933 | Anderson | 52/35 |
| 1,966,167 | 7/1934 | Denk | 52/27 X |
| 2,128,424 | 8/1938 | Marshall | 52/35 |
| 2,723,822 | 11/1955 | McGuire | 248/205.1 |
| 2,857,754 | 10/1958 | Reinert | 52/27 |
| 4,334,394 | 6/1982 | Mader | 52/743 X |

FOREIGN PATENT DOCUMENTS

| | | | |
|---|---|---|---|
| 1202273 | 1/1960 | France | 52/27 |

*Primary Examiner*—J. Franklin Foss
*Attorney, Agent, or Firm*—Marvin E. Jacobs

[57] ABSTRACT

A system to mount soap dishes and the like to tiled walls. A galvanized thin metal plate is placed against the wall in the location of the soap dish with the edges of the plate extending outward under the edges of the surrounding tiles. The plate has many small deformed slits formed in it to accept and trap thin set mortar. The soap dish is bonded to the plate with mortar flowing into the pockets formed by the deformed slits.

8 Claims, 1 Drawing Sheet

SOAP DISH ANCHORING SYSTEM

DESCRIPTION

1. Technical Field

This invention pertains to the construction arts, specifically the mounting of accessories like soap dishes in fields of tile such as found in shower enclosures and backsplashes around tubs and sinks.

2. Background of the Invention

The most desirable and highest quality soap dishes are made from fired and glazed clay materials, sometimes called porcelain or ceramic. These dishes have a porous back surface, which may be textured or convoluted, that is suitable to be solidly mounted to a portland cement mortar wall surface with a portland cement based thin set mortar adhesive. This standard prior art anchoring system is very rugged and has served well for decades.

In recent years, it has become common to use lower cost gypsum board, treated to be water resistant, for wet walls in showers and behind backsplashes and other tiled areas. This approach avoids the cost of floating a mortar wall, a labor intensive task requiring skilled workers. Tile is generally glued to the gypsum board with an organic adhesive or mastic. This works well enough for tile which is not subject to much physical stress.

To maintain the high quality appearance desired by building owners, porcelain soap dishes are still used, even on the gypsum board. But this causes problems. Soap dishes protrude from the wall, presenting tempting projections for people to lean on or bump against. Consequently, these dishes are subjected to considerable physical stress. When so stressed, soap dishes that have been glued to gypsum board often break loose and must be repaired at considerable cost. Gypsum board is nothing more than layers of paper on opposite sides of a gypsum filler. The paper surface simply will not support a layer of adhesive, whether cement based or an organic mastic, as strongly as the more expensive portland cement based mortar walls.

In an attempt to create a stronger mounting system, some tile installers resort to making a hole in the gypsum board, behind the soap dish, through which thin set mortar is allowed to flow. The cured mortar becomes mechanically locked through this hole, achieving a stronger mounting of the soap dish. However, it is always a poor idea to introduce any interruption in the layer of paper on the surface of the gypsum board, as this layer is the only real source of strength in the board. Once broken, fracture cracks readily propagate from the broken edge. Worse yet, moisture seeps in around the soap dish, perhaps wicked in by the cement mortar itself, and attacks and degrades the edges of the hole. In time, extensive rot may be generated within the wall. Thus, these mechanical lock solutions are prone to failure as well. The present invention avoids all of these problems, providing an anchoring system for soap dishes, and other fixtures mounted on a gypsum board wall, that does not require a hole in the board but still is rugged and durable.

SUMMARY OF THE INVENTION

Briefly, our invention utilizes a thin galvanized metal anchor plate sized and shaped to fit behind the soap dish and extend out behind the surrounding field of tiles for additional support. The plate is perforated over its surface and the perforations are distorted out of the plane of the plate to provide myriad small mortar entrapping pockets. The dish is secured to the surface of this plate with thin set cement based mortar that firmly grips both the ceramic soap dish, and the plurality of pockets formed by the plates.

The surface membrane of the gypsum board remains unbroken and strong, thus, alleviating the danger of water leakage and degradation. The anchor plates are inexpensive and add little to the overall cost, in fact, they save the cost of extra mortar placed through the hole in the wall. The mortar still adheres to the wall directly when it squeezes through the perforations in the plate. And the cured structure gains support from the surrounding tiles under which the plate extends.

Additional advantages and benefits will become apparent from a consideration of the drawings, and the detailed discussion thereof that follows.

DETAILED DESCRIPTION OF THE INVENTION

Figure 1:
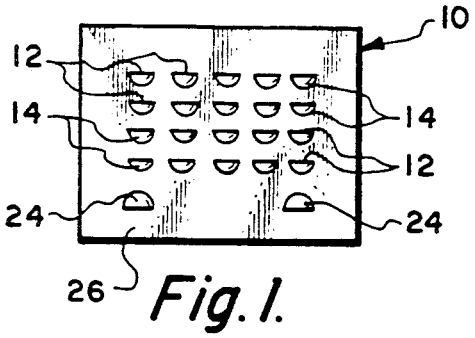
FIG. 1 shows, in elevation, the perforated anchor plate of the present invention.
Figure 2:
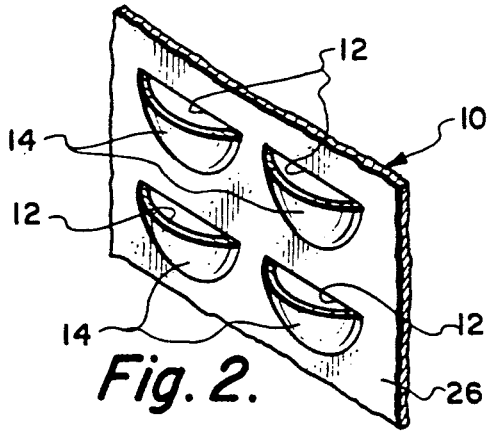
FIG. 2 is a fragmentary portion of the plate of FIG. 1, shown in perspective, to reveal the mortar trapping pockets formed therein.

In FIG. 1, the reinforcing perforated anchor plate 10 of the present invention is shown. Plate 10 may be made from a suitable thin material such as aluminum, plastic, or galvanized 28 gauge steel. Plate 10 includes a plurality of perforations or holes 12 which, in the embodiment shown, comprise horizontal slits. As shown in FIG. 2, slits 12 are deformed or bent upward on one side 14 so as to create mortar trapping pockets thereunder. Of course, any type of hole 12 may be formed in plate 10 and suitably deformed out of the plane of plate 10 to form the pockets. But slits are chosen in the preferred embodiment for ease of manufacture.

Figure 3:
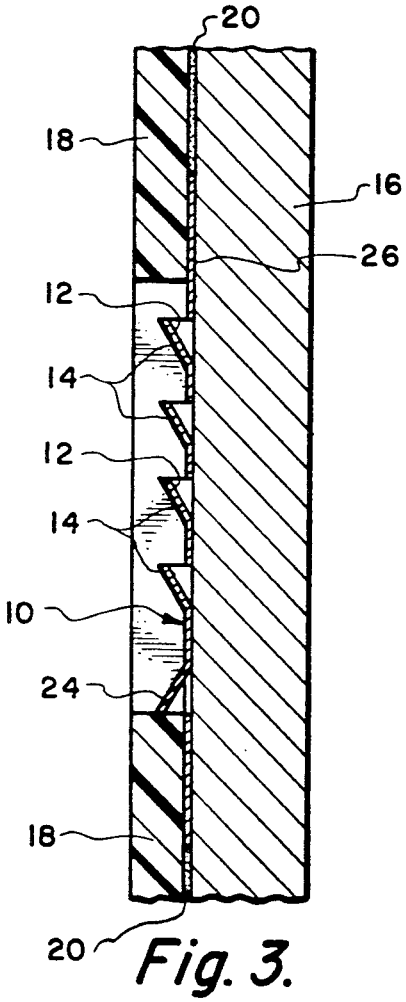
FIG. 3 is a sectional view of a tiled gypsum board wall showing the anchor plate mounted thereon.
Figure 4:
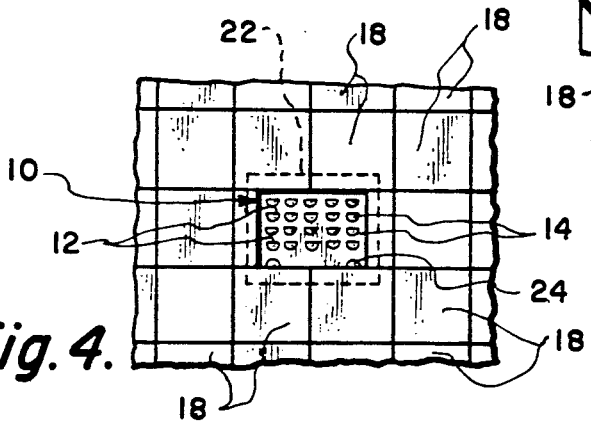
FIG. 4 shows a small area of a tiled wall in elevation with the anchor plate installed under the edges of the tile.

In FIG. 3, a gypsum board wall 16 is sectionally illustrated with plate 10 mounted thereon. For clarity in the drawing, plate 10 is shown somewhat thicker than it really is. Tiles 18 overlap plate 10 on all sides. Tiles 18 may be attached to wall 16 with a layer of mastic adhesive 20 in a conventional fashion. In FIG. 4, a dashed line 22 marks the peripheral edges of plate 10 to show how plate 10 extends outward and under the surrounding tiles in a field of tiles 18.

During installation, tiles 18 would typically be applied to wall 16, with mastic 20, up from the bottom to the desired location of the soap dish. Plate 10 is then slid down under the row of tiles just below the soap dish. To aid in correct placement, plate 10 is provided with two special deformed slits 24 that rest directly on top of the tiles 18 immediately below plate 10, as shown in FIG. 3. The remaining tiles 18 are then glued over the sides and top flange areas 26 of plate 10 as shown in FIG. 4.

Figure 5:
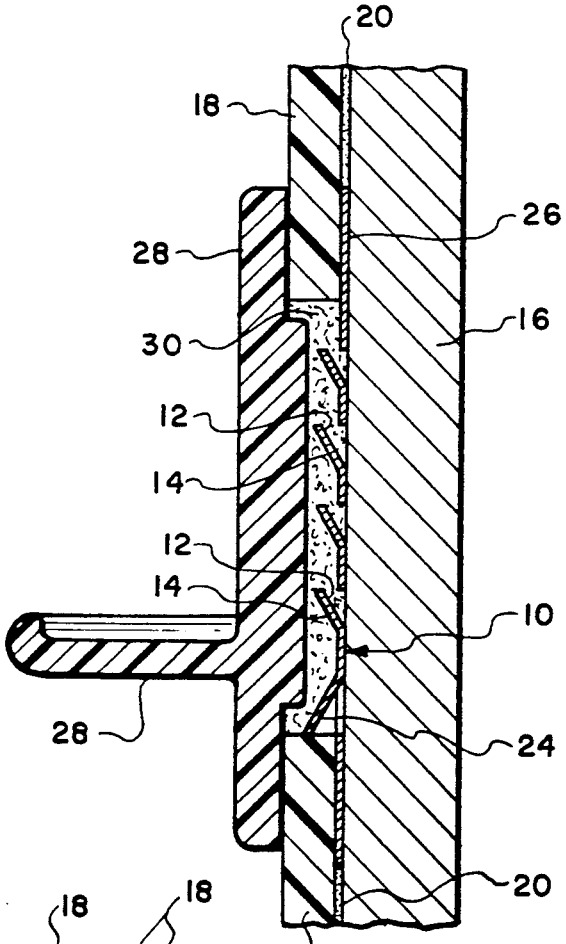
FIG. 5 is a sectional view identical to FIG. 3, with a soap dish additionally secured onto the anchor plate with mortar.

Finally, in FIG. 5, a soap dish 28 is mounted to plate 10 and wall 14 with a thin set cement mortar 30 that flows into and under pockets 14 and into contact with wall 14. When the mortar cures, a unified structure of plate 10, mortar 30, and dish 28 is created that is held firmly about its periphery by flanges 26 extending under the surrounding tiles 18. Mortar inside pockets 14 and through slit shaped holes 12 adheres directly to wall 16.

Clearly many modifications are possible that do not depart from the spirit and scope of the invention. Different shaped holes may be used, deformed in different ways. The choice of mortar is not essential although cement based mortars bond most effectively to the ceramic soap dish. Fixtures other than soap dishes may also be mounted using this anchoring system. Thus, the invention should not be limited except in accordance with the claims appended hereto and their equivalents.

We claim:

1. An anchoring system for mounting fixtures such as soap dishes on a tiled wall comprising in combination:

a generally thin flat anchoring plate adapted to be adhesively mounted flat on the surface of a wall, said plate having peripheral flange areas adapted to extend under the surrounding tiles on the wall and further having a plurality of perforations therethrough, said perforations providing adhesive trapping pockets over the surface of the anchoring plate which trap adhesive under said plate and against said wall; and adhesive material adapted to adhere to the fixture and also to mechanically engage said pockets in said plate and also to adhere to said surface of the wall under said plate.

2. The system of claim 1 in which said fixture comprises a ceramic soap dish and said adhesive comprises a thin set portland cement based mortar.

3. The system of claim 1 in which said perforations comprise slit shaped openings in said plate, at least one side of said slit openings being deformed out of the plane of the plate to create said pockets.

4. The system of claim 1 including positioning projections on said plate located to rest on top of the tiles just below said fixture.

5. The system of claim 2 in which said perforations comprise slit shaped openings in said plate, at least one side of said slit openings being deformed out of the plane of the plate to create said pockets.

6. The system of claim 5 including positioning projections on said plate located to rest on top of the tiles just below said fixture.

7. The method of adhesively mounting a soap dish to a tiled wall comprising the steps of:

tiling the wall with tile except for an area under the soap dish;

placing a perforated anchoring plate flat against and on the surface of the wall in the area under the soap dish with the edges of the plate slid under the edges of the surrounding tiles; and applying thin set mortar to said plate and said soap dish so as to adhere the soap dish to the plate with said mortar mechanically forced into the anchoring plate perforations so as to mechanically lock with the plate and also to adhere to the wall under the plate.

8. The method of claim 7 including the step of deforming the perforations in the plate to enlarge the pockets formed by the perforations.

* * * * *